United States Patent [19]

Goldberg

[11] 4,345,357

[45] Aug. 24, 1982

[54] EQUIPMENT FOR DRYING AND/OR SHRINKING OF TUBULAR TEXTILE STRUCTURES

[75] Inventor: Alan Goldberg, Charlotte, N.C.

[73] Assignee: H. Krantz GmbH & Co., Aachen, Fed. Rep. of Germany

[21] Appl. No.: 147,155

[22] Filed: May 6, 1980

[30] Foreign Application Priority Data

May 11, 1979 [DE] Fed. Rep. of Germany ..... 2918969

[51] Int. Cl.[3] ..... D06G 7/00

[52] U.S. Cl. ..... 26/18.5; 26/81; 34/105; 34/236

[58] Field of Search ..... 26/80, 81, 18.5; 34/105, 236

[56] References Cited

U.S. PATENT DOCUMENTS

| | | | |
|---|---|---|---|
| 87,317 | 3/1869 | Akin | 26/81 |
| 448,817 | 3/1891 | Harder | 26/81 |
| 1,334,164 | 3/1920 | Palmer | 26/81 |
| 1,696,682 | 12/1928 | Kasanof | 26/81 |

*Primary Examiner*—Robert Mackey

*Attorney, Agent, or Firm*—Arthur B. Colvin

[57] ABSTRACT

Method and equipment for drying and/or shrinking of textile structures which are formed into a tubular conformation and sleeved onto a tubular carrier. By the application of a heated gaseous medium under pressure, the tubular conformation is transported in alternate directions on the tubular carrier.

6 Claims, 1 Drawing Figure

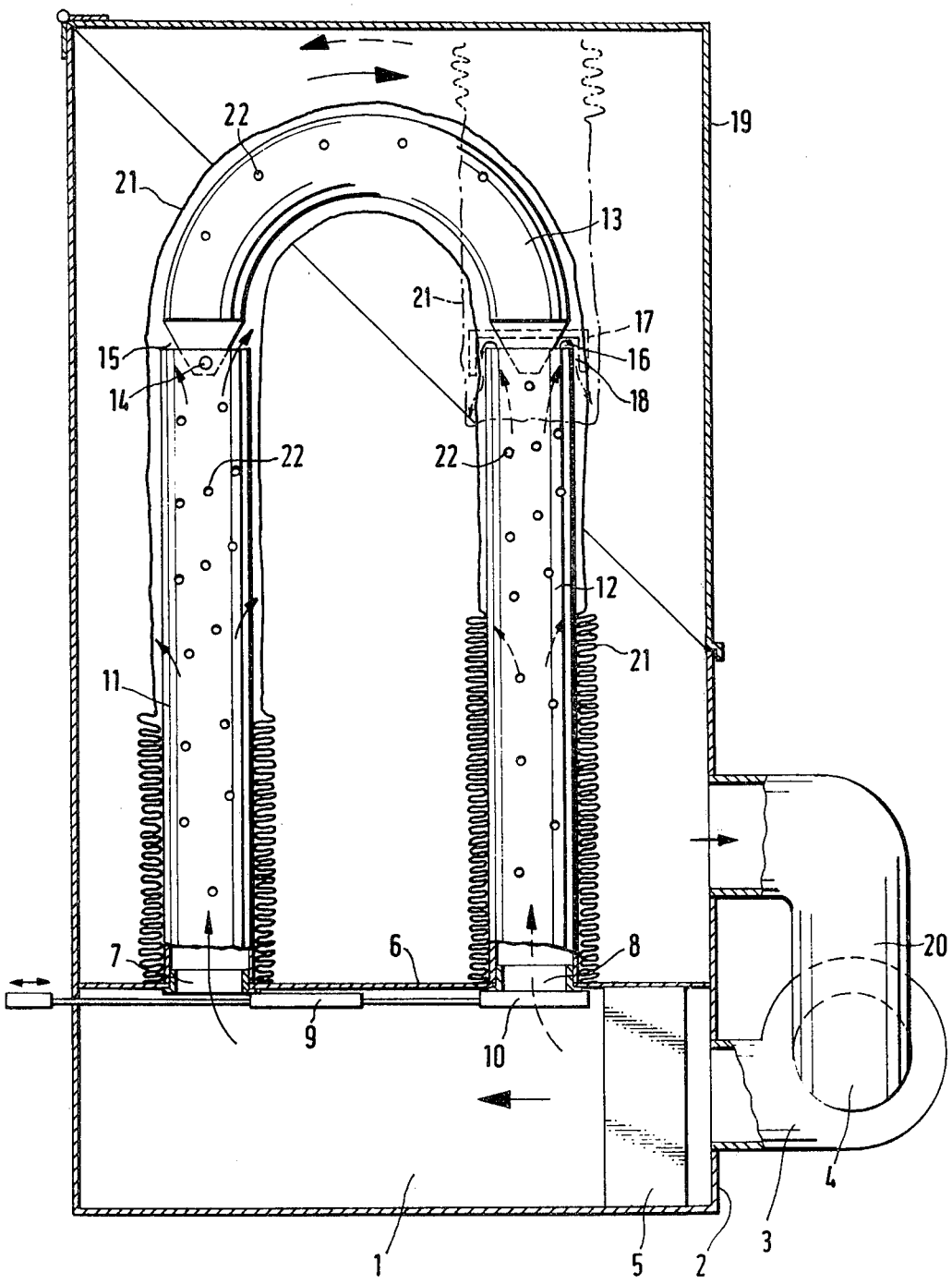
22
21
19
13
21
17
15
16
14
18
22
22
12
21
11
7
6
8
20
9
10
4
1
5
2
3

EQUIPMENT FOR DRYING AND/OR SHRINKING OF TUBULAR TEXTILE STRUCTURES

The invention relates to a method for the drying and/or shrinking of textile structures, the material to be treated being subjected to heated, gaseous medium, and to equipment for the implementation of the method.

During their wet treatment such as dyeing or washing, textile structures are transported through the treatment liquid in web form, the web being constantly subjected to a certain longitudinal tension, whereby the weave or knit structures, particularly to lengthwise elastic material, is changed. This may cause lengthwise distortions affecting the character of the weave or mesh construction so that the desired structure of the material is completely lost during the wet treatment.

To restore the material structure, it is known to lead the textile structure after the wet treatment, through a dryer in a transversely stretched state. Serving as dryers are drum or loop drying machines that allow a certain amount of fabric to be overfed into the drying machine to allow the fabric to shrink to the desired amount. In addition, serving as dryers are tenters which are equipped with clip and/or pin chains and to which the material to be treated can be fed continuously with a certain overfeed so that the material can shrink by the amount of the overfeed while being dried.

When material of great lengthwise elasticity is involved, the maximum amount overfeed possible is usually insufficient to achieve enough shrinkage to restore the desired textile structure. This is due to a number of facts that limit fabric shrinkage. Sometimes the overfeed is limited by the mechanical ability of the clips or pins to hold the surplus material. Often, however the method of drying will not mechanically shrink the cloth to the desired amount regardless of the extent of overfeed entered into the dryer. Apart from the material shrinkability thus being limited, the tenter treatment requires a considerable expense for equipment and energy, which pays only if large material lots are processed continuously.

It is an object of the invention to create a method for the drying and/or shrinking of textile structures, by which any amount of shrinkage of the textile structures is achievable, which can be carried out at little expense for equipment and energy, particularly in the absence of wear-prone transport devices and which can, consequently, also be applied to smaller material lots.

Starting from the method described at the outset, it is suggested to solve the problem posed by having the material form a tube which is pushed coaxially over a tubular carrier and transported in more or less inflated condition by gaseous treatment medium discharging at an acute angle to the longitudinal extent of the carrier.

By the method according to the invention, the tube of material, pushed loosely over a tubular carrier, is inflated by the discharging, heated, gaseous treatment medium and transported over the carrier by means of the kinetic energy of the treatment medium, without additional mechanical transport means gripping the material anywhere and hindering the shrinking process more or less.

According to one embodiment of the method according to the invention, at least a part of the gaseous treatment medium is alternately conducted in opposite directions over the longitudinal extent of the carrier so that the tube of material is moved from one end of the carrier to the other, a reversal of direction occurring every time after most of the tube of material has been compressed in bellowslike folds over a carrier end area.

By the method according to the invention, the tube of material can be transported alternately in opposite directions over the longitudinal extent of the carrier an arbitrary number of times until the textile structure has been dried and/or shrunk enough. Due to the repeated back and forth motion of the tube of material, the longitudinal extent of the tubular carrier may be of relatively small dimension and yet accommodate and treat in optimum manner a relatively long tube of material.

To carry out the method according to the invention, equipment is proposed in which at least one pair of pipe nipples, interconnected via the ends of an essentially U-shaped pipeline, is connected to a pressure box which can be charged, via a heater, by a gaseous treatment medium moved by a blower.

The U-shaped pipeline according to the invention, connected to the pressure box, serves as carrier for the tube of material, treatment medium discharging at an acute angle to the longitudinal extent of the carrier through appropriately designed holes in the pipeline wall so that one component of the jet energy effects the transport of the hose of material.

In order to load the U-shaped pipeline with a tube of material, the legs of the U-shaped pipeline are connected, at their ends opposite the pressure box, to a U-shaped or arcuate pipe section hinged at one leg end and detachably connected at another leg end, according to one embodiment of the invention.

The hinged U-shaped pipe section according to the invention can be moved away from one leg end so that the tube of material can readily be pushed over the leg of the pipeline, from which the U-shaped arcuate pipe section was removed, and also be taken off again after the treatment.

According to one embodiment of the invention, the loading process can further be facilitated in that, for purposes of loading the tube of material, the unhinged leg end of the pipeline can be covered by a cap forming a ring nozzle which directs the gaseous treatment medium flow outside of the leg in the direction of the leg end connected to a nipple at the pressure box.

The effect of charging the pipeline leg, from which the U-shaped or arcuate pipe section was removed, with gaseous treatment medium is that the flow of treatment medium goes through the cap forming a ring nozzle in the direction of the leg end connected to the nipple at the pressure box, so that it is sufficient to push one fabric tube end over the ring nozzle, whereupon the treatment medium flow will attach this tube end, thereby pulling the entire hose of material over the pipeline leg in the direction of the pressure box.

Another embodiment of the invention provides for the U-shaped pipeline to be enclosable in a housing which communicates with the suction side of the blower through a return line.

The embodiment according to the invention provides the possibility of recovering, by means of the housing, the treatment medium penetrating the tube of material, and feeding it through the return line back to the blower to recharge the pressure box so that the treatment medium, filtered if required, and reheated by the amount of cooling, can be circulated constantly so that the equipment can be operated particularly energy-efficient.

Finally, one embodiment of the invention provides, for the control of movable slides controlling the flow of treatment medium into the legs of the U-shaped pipeline, to reverse the transport direction of the hose of material, for a contact which can be triggered by the depositing material and with which adjustable time-delay switching elements are coordinated.

The effect of the slide control according to the invention is that a reversal of the travel direction of the tube of material sets in whenever the tube of material has been deposited on one leg of the U-shaped pipeline so far that only a tube remainder in stretched form remains over the respective other leg of the U-shaped pipeline.

One embodiment example of equipment to carry out the method according to the invention is schematically shown in the drawing.

Referring now to the drawing, the equipment consists of a pressure box 1, to one face 2 of which the pressure nipple 3 of a blower 4 is flanged. A heater 5, which may consist of a heat exchanger, gas burner, or a direct steam blower, takes care of the heating of the gaseous treatment medium.

Flanged to the top 6 of the pressure box are two pipe nipples 7 and 8 which can be closed alternately by slides 9 and 10, respectively.

The pipe nipples 7 and 8 are connected via legs 11 and 12, respectively, to a U-shaped or arcuate pipe section 13 bridging the free ends of the legs 11 and 12. The U-shaped pipe section 13 is hinged as at 14 to the free end of leg 11 so that the U-section 13 can be lifted off the free end of leg 12. The ends of the U-section 13 are designed so as to form with the free ends of the legs 11 and 12 of the pipeline, annular gaps 15 and 16, respectively, through which treatment medium can discharge at an acute angle to the longitudinal extent of the pipeline.

When the U-section 13 is swung away from the free end of leg 12, the leg end can be covered by a cap 17 which forms with the leg end, a ring nozzle 18, so that the flow direction of the treatment medium can be reversed when the cap 17 is in place.

The pipeline formed by the legs 11, 12, and the U-section 13 is enclosed in a housing 19, to which a return line 20 is flanged laterally above the blower 4, leading to the latter's suction side.

The operating mode of the equipment for the implementation of the method according to the invention is as follows:

In order to initially load a textile structure which is in the form of a tube 21, onto the apparatus, the U shaped structure 13 is swung away from the free end of leg 12. One end of the textile length may now be sleeved over the ring nozzle 18 formed by mounting the cap 17 over the end of leg 12. The mounted position of the cap and the position of the lead end of the length of the textile structure are shown in dotted lines in the figure. As soon as the slide 10 has been switched into the open position and the slide 9 into the closed position, and the blower 4 charges the pressure box 1 with treatment medium, such treatment medium will flow through the leg 12 and be deflected by the cap 17 through the ring nozzle 18 downwardly in the direction of the pressure box 1. By this procedure, the treatment medium loads the tube of material 21 downwardly over the leg 12.

As soon as the leg 12 has accepted all of the tube of material 21, the cap 17 is removed and the U-section 13 swung by its hinge into the position shown in the drawing. The treatment medium, transported through the pipe nipple 8 into the leg 12, discharges partly through nozzle-shaped holes 22 in the wall of the pipeline, thereby inflating the hose of material 21. A part of the treatment medium leaves the leg 12 through the annular gap 16 formed by the upper end of leg 12 and the end of the U-section 13 facing it. In this area, the treatment medium discharges at an acute angle to the longitudinal extent of the pipeline and reacts against the hose of material 21 to transport the latter in a counterclockwise direction to the opposite end of leg 11 on the pressure box side, which leg 11 is shut off from being charged directly with pressure medium from the pressure box 1 due to the slide 9 being in closed position.

After the tube of material 21 has been transferred in this manner over the lower area of leg 11 in bellows-shaped folds, except for a stretched end portion on leg 12, the slide 10 is moved to close the nipple 8 while the slide 9 will open the nipple 7. Now treatment medium will flow through the leg 11 and its nozzle-shaped holes 22, a part of the treatment medium discharging through the annular gap 15 formed by the free end of leg 11 and the hinged end of the U-section 13 facing it. The treatment medium discharging through the annular gap 15 now reacts against the tube of material 21 to transport the latter in a clockwise direction toward the end of leg 12, whereupon the treatment process repeats in the manner described.

As soon as sufficient drying and/or shrinking of the textile structure has been obtained, the blower 4 and heater 5 are shut off, whereupon the U-section 13 is swung away from the end of leg 12 so that the finish-treated tube of material 21 can be taken off the U-shaped pipeline.

I claim:

1. Equipment for the drying and shrinking of textile structures formed into a tubular conformation, comprising a pressure box, means for forcing a gaseous treatment medium into said pressure box, heating means for such gaseous medium, first and second spaced vertical perforated pipes rising from said pressure box, each of said pipes having an end in communication with said box, an arcuate pipe section connecting the ends of said vertical pipes remote from said box, means to permit movement of one end of said arcuate pipe section away from an associated vertical pipe to permit sleeving of said tubular conformation on the said associated vertical pipe, and flow control means shiftable between two alternate positions respectively connecting said first pipe to said box and blocking gaseous flow to said second pipe and connecting said second pipe to said box and blocking gaseous flow in said first pipe, whereby said gaseous medium in the pipe connected to said box is caused to react against said tubular conformation and shift the same to the pipe blocked from said gaseous flow.

2. Apparatus in accordance with claim 1 in which said means to permit movement of said one end of said arcuate pipe section constitutes a pivotal connection.

3. Apparatus in accordance with claim 1 and including cap means adapted to be mounted over said associated vertical pipe, said cap means being shaped to divert gaseous treatment medium flowing upwardly through said pipe in a downward direction to thereby react against the tubular conformation sleeved over said pipe and load said conformation downwardly onto said pipe.

4. Apparatus in accordance with claim 1 and including a housing surrounding said pipes, and conduit means connecting said housing to said means for forcing gaseous treatment medium into said pressure box to thereby reintroduce into said pressure box the gaseous treatment medium discharged from said pipes.

5. Apparatus in accordance with claim 1 wherein said flow control means comprises a slide member associated with the ends of said vertical pipes connected to said pressure box.

6. Apparatus in accordance with claim 1 wherein annular gaps are defined at the junctions between said arcuate pipe section and said vertical pipes, said annular gaps being upwardly inclined at an acute angle relative to the length of said vertical pipes.

* * * * *